US008021120B2

(12) United States Patent
Schrey et al.

(10) Patent No.: US 8,021,120 B2
(45) Date of Patent: Sep. 20, 2011

(54) TURBINE BLADE WITH A COVER PLATE AND A PROTECTIVE LAYER APPLIED TO THE COVER PLATE

(75) Inventors: Albert Schrey, Kerken (DE); Gerhard Schwass, Mülheim an der Ruhr (DE); Armin de Lazzer, Mülheim an der Ruhr (DE)

(73) Assignee: Siemens Aktiengesellschaft, Munich (DE)

( * ) Notice: Subject to any disclaimer, the term of this patent is extended or adjusted under 35 U.S.C. 154(b) by 1003 days.

(21) Appl. No.: 11/918,809

(22) PCT Filed: Jan. 20, 2006

(86) PCT No.: PCT/EP2006/050337

§ 371 (c)(1),
(2), (4) Date: Oct. 18, 2007

(87) PCT Pub. No.: WO2006/111427

PCT Pub. Date: Oct. 26, 2006

(65) Prior Publication Data

US 2009/0022583 A1 Jan. 22, 2009

(30) Foreign Application Priority Data

Apr. 21, 2005 (EP) ..... 05008811

(51) Int. Cl.
*F01D 5/20* (2006.01)

(52) U.S. Cl. ..... 416/224; 416/189; 416/241 R; 415/173.6

(58) Field of Classification Search ..... 415/173.1, 415/173.5, 173.6, 174.5; 416/189, 224, 241 R; 428/678; 29/889.7
See application file for complete search history.

(56) References Cited

U.S. PATENT DOCUMENTS

| | | | | |
|---|---|---|---|---|
| 4,285,108 | A * | 8/1981 | Arrigoni | 29/889.1 |
| 4,291,448 | A * | 9/1981 | Cretella et al. | 29/889.1 |
| 4,822,248 | A * | 4/1989 | Wertz et al. | 416/192 |
| 7,537,809 | B2 * | 5/2009 | Ochiai et al. | 427/580 |
| 2002/0109303 | A1 | 8/2002 | Fried | |
| 2003/0107181 | A1 | 6/2003 | Wieghardt | |
| 2003/0183529 | A1 | 10/2003 | Ohara et al. | |

FOREIGN PATENT DOCUMENTS

| | | | |
|---|---|---|---|
| EP | 1 312 760 | A2 | 5/2003 |
| EP | 1 391 537 | A1 | 2/2004 |
| FR | 1 470 032 | | 2/1966 |
| JP | 4913810 | A | 4/1974 |
| JP | 02019603 | A | 1/1990 |
| JP | 2003148103 | A | 5/2003 |

* cited by examiner

*Primary Examiner* — Ninh H Nguyen

(57) ABSTRACT

The invention relates to a turbine blade with a cover plate shaped onto the pan of the blade. The aim of the invention is to provide a turbine blade of this type that, while having a high level of efficiency, is designed for a particularly reliable and safe operation in a turbine, particularly of a steam turbine. To this end, the invention provides that a protective layer made on an alternative material is applied to the surface of the cover plate facing away from the pan of the blade. The friction behavior with regard to a turbine component, particularly a sealing strip, which is opposite the protective layer, can be specifically influenced whereby enabling favorable emergency running properties to be provided in the event of rubbing.

19 Claims, 2 Drawing Sheets

TURBINE BLADE WITH A COVER PLATE AND A PROTECTIVE LAYER APPLIED TO THE COVER PLATE

CROSS REFERENCE TO RELATED APPLICATIONS

This application is the US National Stage of International Application No. PCT/EP2006/050337, filed Jan. 21, 2006 and claims the benefit thereof. The International Application claims the benefits of European application No. 05008811.1 filed Apr. 21, 2005, both of the applications are incorporated by reference herein in their entirety.

FIELD OF INVENTION

The invention relates to a turbine blade with a cover plate integrally formed onto the blade leaf and to a steam turbine provided with a number of turbine blades of this type.

BACKGROUND OF THE INVENTION

The turbine blades of steam turbines are often provided with a cover plate in each case integrally formed on the head side on the blade leaf. Normally, the turbine blades combined in each case into moving blade rows or guide blade rows are arranged on the rotor or on the casing of the steam turbine in such a way that the whole of the cover plates of a blade row which in each case project laterally beyond the blade leaf forms a continuous ring, what is known as a shroud. In this case, the cover plates of the turbine blades assigned to a blade row are, as a rule, keyed or clamped with respect to one another during installation, in such a way that further fastening means or connection elements between the individual cover plates can be dispensed with. By the turbine blades being coupled in the annular shroud, vibrations or distortions of individual turbine blades which occur as a result of high dynamic stress are effectively suppressed.

The cover plates or a blade row in each case combined into a shroud are designed to minimize the gap and edge losses caused by a secondary flow over the blade tips or the shroud. For this purpose, particularly when the steam turbine is operating under full load, as small a gap width as possible is desired between the shroud and the casing or rotor lying opposite it. On the other hand, brushing during operation should as far as possible be avoided. Particularly during unsteady operating actions, that is to say, for example, during starting and in the event of load changes, however, there is the risk of comparatively pronounced relative length changes of the components involved which are caused by different thermal expansion, so that, in exceptional cases, brushing still has to be reckoned on. In order to keep the expansion of potential contact points as low as possible and therefore also minimize the frictional forces occurring in the event of contact, metal strips or metal rings, what are known as sealing bands, fastened to the shroud or to the casing or rotor lying opposite it and running in the circumferential direction are used. When rotating and stationary parts come nearer to one another than planned, first the comparatively thin sealing bands in this case come into contact with the opposite component, the surfaces of the two contact partners grinding against one another in a usually locally limited wearing region. This ensures sufficient emergency running properties, at least in the case of once-only or brief brushing.

If operating states of this type occur more frequently, however, there is, if the sealing bands are attached in each case to the turbine component lying opposite the shroud, that is to say to the casing (in the case of a moving blade shroud) or to the rotor (in the case of a guide blade shroud), the risk of continued wear which damages the cover plates or the shroud as a whole. In this case, under certain circumstances, the sealing band may "pit" deeply into the shroud, which after some time may even lead to an almost complete removal of the shroud. The stability of the originally annularly closed composite cover plate structure is considerably diminished due to wear-induced local interruptions, this being conducive to the occurrence of blade oscillations. Moreover, in the case of continued wear or excessively high oscillation amplitudes, fragments of macroscopic size or even whole turbine blades may come loose and then be thrown with high momentum against the turbine blades or casing parts of the following turbine stages. In an extreme case, this may lead to a complete destruction of the steam turbine.

FR-A-1 470 032 discloses turbine blades with shrouds.

US 2003/107181 A1 discloses a seal between a stationary and a movable part, the immovable part having an abrasive layer and the movable part being arranged touch-near to this abrasive layer.

EP 1 312 760 discloses a turbine blade tip with an abrasive surface, the abrasive surface comprising abrasive particles.

US 2003/183529 A1 discloses abrasive layers with a high oxidation resistance.

SUMMARY OF INVENTION

The object on which the invention is based, therefore, is to specify a turbine blade of the abovementioned type which, along with high efficiency, is designed for especially reliable and safe operation. Furthermore, a steam turbine equipped with turbine blades of this type is to be specified.

As regards the turbine blade, the object is achieved, according to the features of the claims.

The invention proceeds in this case from the consideration that a steam turbine should be designed for operating with what are known as "high steam parameters" in order to achieve high efficiency. In particular, action upon the turbine blades with steam of as high a temperature as possible should take place. In this case, the aim is to have steam temperatures of above 500° C. to about 700° C. Correspondingly, the turbine blades, but also the casing components forming the flow duct for the steam should be manufactured from material having high heat resistance. In view of the comparatively high mechanical load on the turbine blades, in particular on the moving blades rotating at high speeds, the material for manufacturing the respective blade body should fulfill the highest possible requirements as to mechanical stability and crack resistance at the high operating design temperatures. In order to keep the manufacturing costs for the turbine blades as low as possible, however, the material should at the same time also be capable of being processed relatively simply (for example, by casting). Furthermore, to avoid flow losses, the respective radial gap between the shroud connecting the blade tips of a blade row and the turbine components lying opposite said shroud (that is to say, the turbine casing in the case of a moving blade shroud or the rotor in the case of a guide blade shroud) should have as small a width as possible. Since, under the influence of the high operating design temperatures and because of deviations possibly occurring in the temperature profile from a temperature profile symmetrical with respect to the center axis of the steam turbine, deformations of the rotor and/or of the casing and therefore deviations of the gap shape from a perfect ring shape may occur, the design of the steam turbine should not basically rule out, in the critical regions of maximum approach, at least temporary contact between the shroud and the rotor or casing lying opposite it. On the contrary, even in the case of brushing, sufficient emergency running properties should be ensured in order to avoid catastrophic turbine damage. Preferably, brushing actions of this type should even be permitted repeatedly during the regular operation of the turbine, without this entailing appreciable consequences.

The invention proceeds, furthermore, from the consideration that the quality of emergency running properties of this type is determined by the frictional behavior between the respective contact faces. In addition to the properties of a liquid film of condensed steam particles which is present under certain circumstances at the interfaces, the frictional properties directly include the respective surface material of the two friction partners, while the aim is not only to have as low a coefficient of friction as possible but the type of wear occurring during friction should also be taken into account.

What has in this case been recognized to be particularly harmful is the "adhesion wear", as it is known, which is caused by the formation of a local adhesive interface bond and the subsequent breaking open of the solid-state connection and which is associated with material breakaway and the transfer of material to the friction partners touching the breakaway point. In other words: microparticles removed from one of the friction partners collect on the surface of the other friction partner and may form there relatively large lumps which, in turn, increase the wearing action. In this case, the accumulated material, due to its wedge effect, exerts impacts on the rotor shaft.

It is precisely this selfreinforcing mechanism of adhesion wear, in which, under certain circumstances, comparatively large fragments come loose from the wearing point, which should be avoided for a permanently reliable operation of the steam turbine with brushing actions which are calculated in and occur occasionally. However, possibly, those very materials, the use of which is preferred for strength reasons or for reasons of processability for the manufacture of the turbine blades and of the cover plates in each case integrally formed onto these, have an unfavorable friction behavior in relation to the surface lying opposite the shroud (as a rule, the surface of a metallic sealing band). By a protective layer consisting of an alternative material being applied to the surface of the respective cover plate or shroud, therefore, additional degrees of freedom for the directed influencing of the friction pairing are provided. To be precise, this outer layer does not have to perform a carrying function but, instead, may be designed specifically for providing especially favorable friction and wear properties in relation to the respective friction partner, in particular so as to avoid adhesion wear. In view of the advantages which can be achieved, a slightly increased outlay in terms of manufacture is in this case perfectly acceptable.

To avoid possible fractures, the blade body, subjected to particularly high stress and which comprises the blade leaf and the cover plate, of the turbine blade is advantageously manufactured from a one-component workpiece. For example, steel, in particular steel with a 10% to 13% chrome fraction, could be used as heat-resistant material for the cover plate or the entire blade body. As a particularly heat-resistant and also corrosion-resistant material suitable for steam temperatures of up to 700° C., however, preferably a nickel-based alloy or a cobalt-based alloy is used as the basic material for the blade body.

The protective layer applied to the surface of the respective cover plate is formed by what is known as an armor alloy based on cobalt. The composition of the alloy is in this case aimed specifically at a high heat resistance and wear resistance and also the provision of an advantageous frictional behavior in interaction with the respective (potential) friction partner, that is to say, in particular, a metallic sealing band lying opposite the respective shroud. It is in this case considered advantageous if, in the case of brushing, the two contact faces grind against one another, at the same time loosening comparatively small metallic dust particles, without this resulting in material transfer or the breakaway of larger fragments. In this case, the microscopically fine grinding dust is simply entrained by the steam flowing through the turbine and is transported away from the flow duct.

In an actual situation, the composition of the armor alloy forming the protective layer must be co-ordinated with the material of the opposite sealing bands. Within the framework of comparative tests, what has proved generally advantageous is an alloy which also contains, in addition to cobalt (chemical symbol: Co), fractions of nickel (Ni), iron (Fe), chromium (Cr), manganese (Mn), carbon (C), silicon (Si) and tungsten (W). The composition (as a percentage by weight) is as follows:

| Ni | Fe | C | Cr | Mn | Si | W |
|---|---|---|---|---|---|---|
| Max. 3 | Max. 3 | 1, 1-1.2 | 28 | 1.0-1.1 | 1.0-1.1 | 4.5 |

Armor alloys of this type are also familiar under the trademark "Stellite" registered by the Deloro Stellite Company. The use of the material class "Stellite No. 6" is particularly preferred within the framework of the novel concept.

Preferably, the hard alloy used for armoring the shroud is applied to the shroud surface by means of a build-up welding method and is therefore connected in a materially integral way to the basic material. In this case, the coating material is applied to the workpiece surface by the build-up of weld beads in one or more layers, for example by means of a gas, arc or inert-gas welding method. Plasma powder build-up welding, as it is known, or laser beam build-up welding may also be employed. The build-up welding alloys used are added as wire, rod, powder or paste, depending on the selected method. On account of their usually smooth and flat surface, the cover plates or the shrouds of turbine blades can be coated particularly well in this way.

In contrast to surface coatings in the μm range, which can be generated by means of possible alternative coating methods, such as, for example, vapor deposition, surface hardening, nitriding or boronizing, the protective layer generated in this way has a significant thickness of preferably approximately 1 mm or more. This ensures a comparatively long useful life of the protective layer, the latter, in principle, outliving the complete removal of the sealing band lying opposite it, without the basic material of the cover plates being damaged.

In a preferred alternative refinement, a hard material layer is provided as a protective layer on that surface of the cover plate which faces away from the blade leaf. What are designated as hard materials in a way which is relevant to a person skilled in the art are naturally hard materials which do not have to undergo any secondary heat treatment for hardening. The use of hard materials of this type has the advantage that the wear of a protective layer produced from them is comparatively low even after lengthy use, and that, instead, in the event of contact, the comparatively softer sealing band on the casing lying opposite the cover plate or on the rotor of the steam turbine is worked off in a directed way. The sealing band therefore has to be renewed only from time to time.

Hard materials with a covalent, ionic or metallic bond are known. A prominent representative of hard materials with a covalent bond and at the same time the hardest naturally occurring mineral is diamond. The hard materials with an ionic bond include, for example, aluminum oxide or chrome oxide, but also ceramic.

The coating provided for protecting the respective cover plate or shroud is preferably produced from a metallic hard material. The carbides and nitrides formed by the elements of the transition metals are preferred in this case in terms of their frictional behavior and also because of their mechanical and thermal stability. Chrome carbide or titanium nitride or boron nitride is provided as a particularly preferred hard material.

The hard material layers generated preferably by plasma spraying or flame spraying, which can be handled particularly effectively even on an industrial scale, or by a PVD method (physical vapor deposition) are distinguished by good adhesive strength on the metallic base of the cover plate and also by high purity and therefore by particularly clearly defined and unfalsified surface qualities. The thickness of thin layers of hard material of this type is normally in the μm range.

The protective layer could in each case be applied individually to the cover plates of the turbine blades before the mounting of these on the rotor or on the casing of the steam turbine takes place. In the application of a thin layer of hard material (for example, by a PVD method or by plasma spraying or the like), but, in particular, also in the case of armoring by build-up welding ("stelliting"), however, it is particularly advantageous to subject the shroud as a whole, formed from the cover plates of the already mounted turbine blades and turned into circular shape, to coating. The manufacturing steps (which may involve pretreatment and secondary treatment) necessary for applying the protective layer are therefore in each case employed on a portion of the shroud which comprises a plurality of cover plates. To be precise, in the mounted state, for build-up welding, only a comparatively few long welding beads have to be drawn over the circumference of the shroud, in contrast to hundreds of short welding beads in the case of the individual blades. The method provided in this case is in process terms faster and more reliable and delivers a better quality on account of the smaller number of put-on and take-off points. It is also particularly suitable for a repair or renovation of a worn or not yet coated old shroud.

An abrasive layer is advantageously applied to the hard material layer. Upon mutual contact, the metallic sealing band can first be worked into this abrasive, that is to say soft layer, before it comes into contact with the hard material layer lying beneath. The sealing band is not damaged upon contact with the abrasive layer, but, instead, preserves its original dimensions and sealing action. In other words: since the surface contour of the abrasive layer adapts to the sealing band lying above it or sliding beyond it (the abrasive layer "yields as required"), the radial play between the rotating and the stationary part of the steam turbine can be kept deliberately low, thus contributing to high efficiency.

The specified turbine blade is preferably an integral part of a steam turbine. However, it could also be used in a gas turbine. In this case, a number of turbine blades of this type is combined in each case into a blade row, the cover plates of the turbine blades assigned to a blade row in each case being shaped and arranged in relation to one another in such a way that they form a continuous shroud covered with a protective layer consisting of an alternative material. In the case of a moving blade row, advantageously, a number of sealing bands arranged circumferentially on the inside of the turbine casing are provided opposite the coated surface of the assigned moving blade shroud. In the case of a guide blade row, sealing bands of this type are advantageously arranged, opposite the coated surface of the guide blade shroud, on the outside of the turbine shaft.

Preferably, a sealing band of this type comprises a number of strips which are bent or shaped in the form of a ring segment and which are produced from a highly heat-resistant cold-deformable steel, in particular from a martensitic or austenitic steel or a nickel-based material. The following table lists some suitable examples with their chemical designations, their trade names (if present) and their international material numbers:

| Chemical designation | Material number | Trade name |
|---|---|---|
| X20CrMo13KG | 1.4120 | |
| X22CrMoV12-1KG | 1.4923 | |
| X6CrNiMoTi17-12-2 | 1.4571 | |
| X6NiCrTiMoVB25-15-12 | 1.4980 | A286 |
| NiCr23Co12Mo | 2.4663 | Inconel 617 |
| NiCr20Ti | 2.4951 | Nimonic 75 |

Instead of sealing bands caulked into a corresponding reception groove (that is to say, consolidated in their seat with caulking material) or directly inserted ("rolled") into a corresponding reception groove, integrally formed or lathe-turned sealing ribs may also be provided on the turbine component (rotor or casing or a part segment thereof) lying opposite the shroud. The sealing bands or sealing ribs, may, if appropriate, also be of spirally continuous design.

The advantages achieved by means of the invention are, in particular, that the degrees of freedom in terms of material selection and surface structuring, which are obtained by a protective layer being applied to the respective cover plate, are utilized in a directed way for advantageously influencing the frictional behavior with respect to a sealing band which possibly comes into contact with the cover plate. The radial plays between the rotating and the stationary part of the steam turbine can be designed to be lower, since comparatively favorable emergency running properties arise upon contact. As a result, higher efficiencies can be implemented than when contact is avoided under all circumstances owing to sufficiently large radial plays or a generously designed safety distance. The basic shroud material critical for the stability of the annular shroud structure is protected by the applied protective or separating layer against wear caused by friction and/or by corrosion. In so far as the protective layer has sufficient hardness, abrasion phenomena can as far as possible be shifted on one side onto the sealing band which can be renewed in a comparatively simple way from time to time.

BRIEF DESCRIPTION OF THE DRAWINGS

Various exemplary embodiments of the invention are explained in more detail with reference to the drawing in which.

Identical parts are given the same reference symbols in all the figures.

DETAILED DESCRIPTION OF INVENTION

Figure 1:
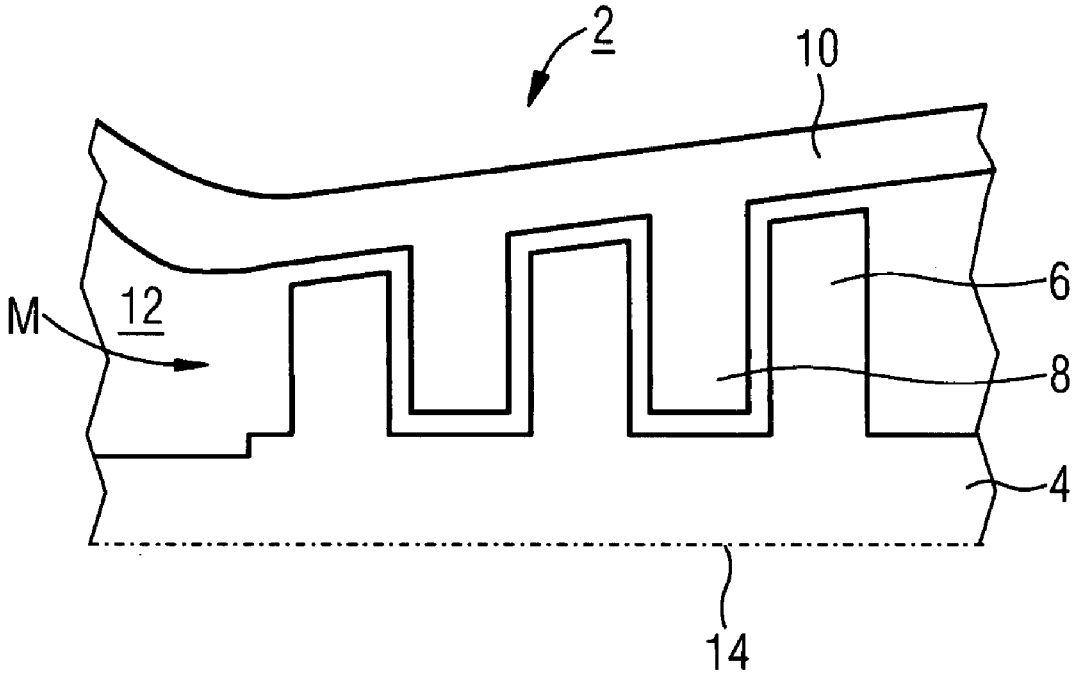
FIG. 1 shows a diagrammatic illustration of a steam turbine in longitudinal section (detail)

FIG. 1 shows a steam turbine 2 with a number of rotatable moving blades 6 connected to the turbine shaft 4. The moving blades 6 are in each case arranged in the form of a ring on the turbine shaft 4 and thus form a number of moving blade rows. Furthermore, the steam turbine 2 comprises a number of stationary guide blades 8 which are likewise fastened in the form of a ring to a turbine casing 10 of the steam turbine 2 so as to form guide blade rows. The flow duct 12, delimited by the turbine shaft 4 and the turbine casing 10, of the steam turbine 2 has a vaporous working medium M flowing through it in a main flow direction running parallel to the center axis 14, the steam, which is heated on the inlet side to a temperature of above 540° C. and is under a high pressure of, for example, 250 bar, expanding so as to perform work and at the same time driving the turbine shaft 4 by pulses being transmitted to the moving blades 6. By contrast, the guide blades 8 serve for routing the flow of working medium M in each case between two moving blade rows or moving blade rings which succeed one another, as seen in the flow direction of the working medium M. A successive pair of a ring of guide blades 8 or a guide blade row and of a ring of moving blades 6 or a moving blade row is in this case also designated as a turbine stage.

Figure 2:
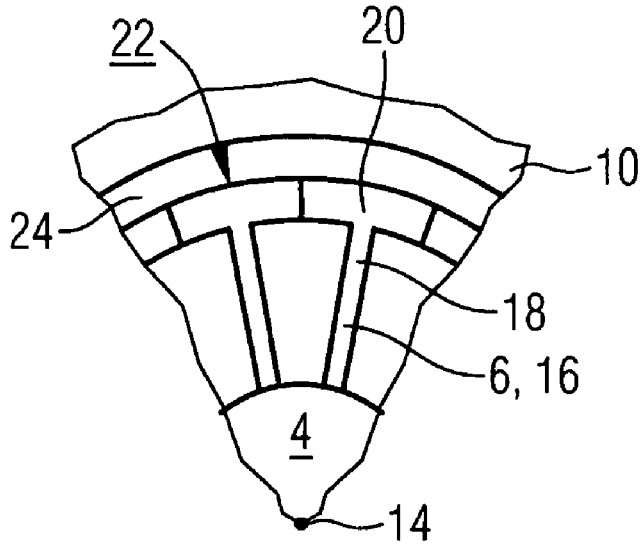
FIG. 2 shows a cross section through a steam turbine according to FIG. 1 with a plurality of turbine blades combined into a blade row, the cover plates of the individual turbine blades being combined into a continuous shroud.

FIG. 2 shows a detail of a cross section, running perpendicularly with respect to the center axis 14, through the steam turbine 2, on which a number of turbine blades 16, in this case a number of moving blades 6, can be seen. The moving blades 6 fastened in the form of a ring to the turbine shaft 4 have on their head-side, that is to say radially outward-directed end in each case a laterally projecting cover plate 20 integrally formed onto the profiled blade leaf 18. The cover plates 20 of two adjacent moving blades 6 in each case are in contact with one another. To be precise, when the moving blades 6 are mounted on the turbine shaft 4, the cover plates 20 are braced with respect to one another in such a way as to form a closed annular composite structure, what is known as a shroud 22. Distortions of the individual blade leaves 18 or oscillations of the blade tips are thereby effectively suppressed. Although, in aerodynamic terms, it is desirable for adjacent cover plates to bear one against the other over their entire axial extent (in the direction of the turbine axis), this cannot always be implemented for structural reasons. "Linear contact" during operation, in which the shroud is therefore closed at only one point in the axial direction of extent (as shown in FIG. 2), is perfectly sufficient in practice.

The radial gap 24 between the circular outer circumference of the shroud 22 and the inside, opposite it, of the turbine casing 10 is, on the one hand, kept as small as possible, in order to minimize the gap losses (due to the secondary flow of the working medium M over the blade tips or over the shroud 22). On the other hand, the radial gap 24 is dimensioned with a width such that certain fluctuations in the radii or deviations from the circular shape, which usually occur during the operation of the steam turbine 2 and are induced by heating or caused by mechanical influences do not lead to a brushing of the rotating shroud 22.

In addition to the moving blades 6, the guide blades 8 of the steam turbine 2 may also have cover plates 20 which are integrally formed on the respective blade leaf 18 and which in their entirety form a shroud 20 assigned to the respective guide blade row, in this case, therefore, a guide blade shroud, which is spaced apart from the turbine shaft 4 by a radial gap 24 in a similar way (but not illustrated in any more detail here).

The efficiency of the steam turbine 2 is optimized by the stipulation of a particularly small radial play, although this also increases the likelihood of brushing actions. So that high operating reliability can nevertheless be ensured, the turbine blades 16 of the steam turbine 2 are aimed specifically at the provision of favorable emergency running properties. This is explained with reference to the moving blade 6 illustrated by way of example in FIG. 3 as an illustration of a detail. However, all considerations relating to this can also be transferred easily to the guide blades 8 of the steam turbine 2.

Figure 3:
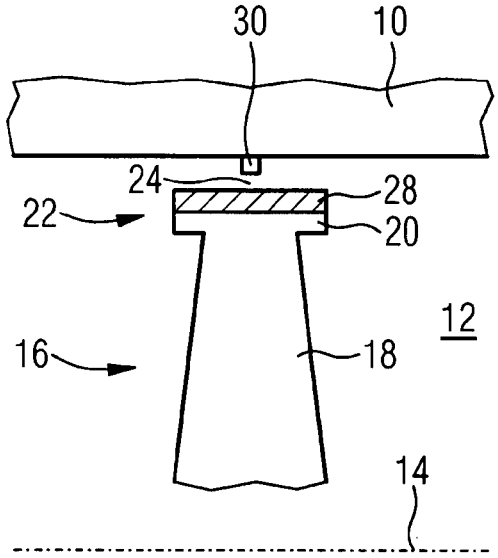
FIG. 3 shows an illustration of a detail of a turbine blade provided with a cover plate, in a steam turbine according to FIG. 1, a protective layer consisting of an alternative material being applied to the cover plate.

The turbine blade 16, illustrated diagrammatically in FIG. 3, which is designed as a moving blade 6, has a cover plate 20 integrally formed onto the blade leaf 18, the blade body comprising the blade leaf 18 and the cover plate 20 being manufactured from a one-component workpiece consisting of a nickel-based alloy in order to achieve high mechanical stability and thermal resistance. The cover plate is provided, on its side facing away from the blade leaf 18, hence facing the turbine casing 10 of the steam turbine 2, with a protective layer 28 consisting of chrome carbide and applied by plasma spraying. Opposite the protective layer 28 and spaced apart from this by a radial gap 24, a sealing band 30 composed of a plurality of ring segments is arranged circumferentially on the inside of the turbine casing 10. Should the sealing band 30, as a result of thermal expansion processes within the steam turbine 2, come into contact temporarily, at a point on its circumference, with one of the cover plates 20 or with the shroud 22 formed by the whole of the cover plates 20 of a blade row, then the basic material of the respective cover plate 20 is protected from wear by the protective layer 28. Owing to the comparatively high hardness of the protective layer 28 formed from a hard material (here, in the exemplary embodiment, chrome carbide), in the event of mutual contact the sealing band 30, in the first place, is worked off in a directed and reliable way, so that it cannot penetrate into the actual cover plate 20 or the shroud surface.

Figure 4:
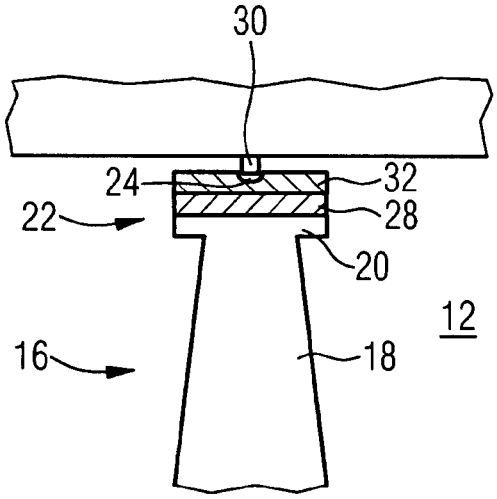
FIG. 4 shows a turbine blade with a cover plate having a protective layer in an alternative embodiment.

The turbine blade 16 from FIG. 4, which may be designed as a moving blade 6 or as a guide blade 8, is constructed in a similar way to the turbine blade known from FIG. 3, although an additional abrasive layer 32 is applied to the protective layer 28. The radial gap 24 between the doubly coated shroud 22 and the sealing band 30 lying opposite it is in this case designed to be so small that, while the steam turbine 2 is in operation, the configuration shown in FIG. 4 is established, in which the sealing band 30 has already ground into the abrasive layer 32, but generally does not come into contact with the hard material protective layer 28 lying beneath. As a result, on the one hand, particularly good sealing of the flow duct 12 is achieved, while, on the other hand, no appreciable frictional losses occur owing to the favorably selected properties of the abrasive layer 32. The protective layer 28 manufactured from a hard material protects the shroud 22, as before, in the event of pronounced fluctuations in the gap spacing and at the same time ensures acceptable emergency running properties.

Figure 5:
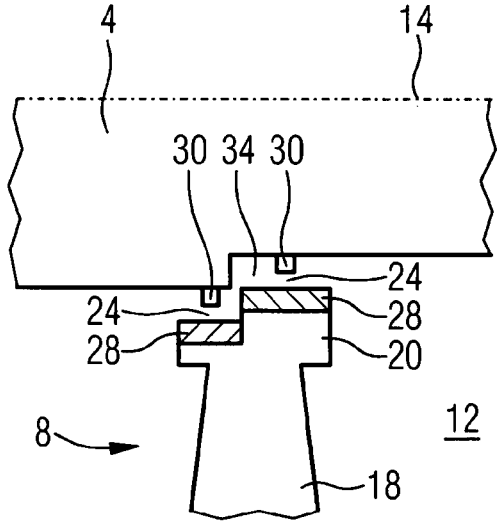
FIG. 5 shows a turbine blade with a cover plate having a protective layer in a further alternative embodiment.

In the guide blade 8 illustrated in FIG. 5, the cover plate 20 or the shroud 22 formed by all the cover plates 20 of the guide blade row has a stepping adapted to a stepping of the opposite turbine shaft 4, so that a labyrinthinely angled subduct 34 of the flow duct 12 is formed between them. The subduct 34 is sealed off by the sealing bands 30 arranged circumferentially on the turbine shaft 4, there remaining in each case a radial gap 24, the width of which fluctuates during the operation of the steam turbine 2. In order to provide particularly favorable emergency running properties in the event of brushing, the cover plate 20 or shroud 22 manufactured from a highly heat-resistant material is covered, as in the previous examples, with a protective layer 28 consisting of an alternative material and coordinated in terms of its friction and wear properties with the sealing band material. The protective layer 28 could again be produced from a hard material. In the present case, however, it is a stellite layer which is applied by build-up welding to each of the part faces forming the steps and which has a thickness of originally approximately 1 mm, which, however, has decreased slightly due to remachining.

It will be appreciated by a person skilled in the art that the exemplary embodiments illustrated by means of the figures can be modified in many different ways, without in this case abandoning the concept essential for the invention. Thus, for example, a stepping could also be provided in a moving blade shroud, or the stepping could have a contour deviating from FIG. 5. Finally, a plurality of sealing rings or sealing bands 30 spaced apart in the axial direction of the steam turbine 2 could also be combined into a group of sealing bands 30 which lie opposite the respective shroud 22 and thus implement multiple sealing off.

The invention claimed is:

1. A turbine blade for a steam turbine, comprising:

a cover plate integrally formed onto a blade leaf of the blade; and a protective layer that consists of an alternative material applied to a surface of the cover plate that faces away from the blade leaf, where the protective layer is formed by a cobalt based armor alloy comprising:

a maximum of 3% nickel, a maximum of 3% iron, approximately 1.1% to 1.2% carbon, approximately 28% chrome, approximately 1.0% to 1.1% manganese, approximately 1.0% to 1.1% silicon, and 4.5% tungsten.

2. The turbine blade as claimed in claim 1, wherein the blade body which comprises the blade leaf and the cover plate manufactured from a single component workpiece.

3. The turbine blade as claimed in claim 2, wherein the cover plate is produced from a nickel-based or a cobalt-based alloy.

4. The turbine blade as claimed in claim 1, wherein the protective layer is applied to the cover plate by build-up welding.

5. The turbine blade as claimed in claim 4, wherein the protective layer is formed by a hard material.

6. The turbine blade as claimed in claim 5, wherein the hard material layer is formed by a metallic hard material.

7. The turbine blade as claimed in claim 6, wherein the hard material is chrome carbide, titanium nitride or boron nitride.

8. The turbine blade as claimed in claim 7, wherein the hard material layer is applied to the cover plate by plasma spraying or by a PVD method.

9. The turbine blade as claimed in claim 8, wherein an abrasive layer is applied to the hard material layer.

10. A steam turbine, comprising:

a rotationally supported turbine shaft; and a plurality of turbine blades arranged on the shaft where the blades are arranged to form a plurality of blade rows, wherein each blade comprise:

a cover plate integrally formed onto a blade leaf of the blade; and a protective layer that consists of an alternative material applied to a surface of the cover plate that faces away from the blade leaf, where the protective layer is formed by a cobalt based armor alloy comprising:

a maximum of 3% nickel, a maximum of 3% iron, approximately 1.1% to 1.2% carbon, approximately 28% chrome, approximately 1.0% to 1.1% manganese, approximately 1.0% to 1.1% silicon, and 4.5% tungsten.

11. The steam turbine as claimed in claim 10, wherein the cover plates of the turbine blades assigned to a blade row are in each case shaped and arranged in relation to one another to form a continuous shroud.

12. The steam turbine as claimed in claim 11, wherein the blade row is a moving blade row.

13. The steam turbine as claimed in claim 12, wherein a plurality of sealing bands and/or sealing ribs are arranged circumferentially on the inside of the turbine casing opposite the coated surface of the shroud.

14. The steam turbine as claimed in claim 13, wherein the blade row is a guide blade row.

15. The steam turbine as claimed in claim 14, wherein a plurality of sealing bands and/or sealing ribs are arranged circumferentially on the turbine shaft opposite the coated surface of the shroud.

16. The steam turbine as claimed in claim 15, wherein a sealing band comprises a plurality of metal strips bent in the form of a ring segment.

17. A method for producing a steam turbine with a plurality of turbine blades, comprising:

providing a rotationally supported turbine shaft; and arranging a plurality of turbine blades on the shaft where the blades form a plurality of blade rows and each blade comprises:

a cover plate integrally formed onto a blade leaf of the blade; and a protective layer that consists of an alternative material applied to a surface of the cover plate that faces away from the blade leaf, where the protective layer is formed by a cobalt based armor alloy comprising:

a maximum of 3% nickel, a maximum of 3% iron, approximately 1.1% to 1.2% carbon, approximately 28% chrome, approximately 1.0% to 1.1% manganese, approximately 1.0% to 1.1% silicon, and 4.5% tungsten, and where the cover plates of the turbine blades form a continuous shroud, the protective layer being applied to the shroud only after the mounting of the turbine blades on the turbine shaft.

18. The method as claimed in claim 17, wherein the protective layer is applied in each case in a plurality of manufacturing steps to an interconnected portion, formed by a plurality of cover plates of the shroud, in each manufacturing step the entire portion being machined or treated.

19. The method as claimed in claim 18, wherein an armor alloy based on cobalt is applied by build-up welding.

* * * * *